US005426700A

United States Patent [19]

Berson

[11] Patent Number: 5,426,700

[45] Date of Patent: Jun. 20, 1995

[54] METHOD AND APPARATUS FOR VERIFICATION OF CLASSES OF DOCUMENTS

[75] Inventor: William Berson, Westport, Conn.

[73] Assignee: Pitney Bowes Inc., Stamford, Conn.

[21] Appl. No.: 110,268

[22] Filed: Aug. 23, 1993

[51] Int. Cl.[6] ..... H04K 1/00

[52] U.S. Cl. ..... 380/23; 380/51; 380/30

[58] Field of Search ..... 380/23, 30, 51

[56] References Cited

U.S. PATENT DOCUMENTS

| | | | |
|---|---|---|---|
| 4,879,747 | 11/1989 | Leighton | 380/23 |
| 4,893,338 | 1/1990 | Pastor | 380/25 |
| 4,933,970 | 6/1990 | Shamir | 380/30 |
| 4,947,430 | 8/1990 | Chaum | 380/23 |
| 4,991,205 | 2/1991 | Lemelson | 380/5 |
| 4,993,068 | 2/1991 | Piosenka | 380/23 |
| 4,995,081 | 2/1991 | Leighton | 380/23 |
| 4,995,082 | 2/1991 | Schnorr | 380/23 |
| 5,142,577 | 8/1992 | Pastor | 380/23 |
| 5,157,726 | 10/1992 | Merkle et al. | 380/23 |

FOREIGN PATENT DOCUMENTS

| | | | |
|---|---|---|---|
| 0334616 | 9/1989 | European Pat. Off. | 89/39 |
| 2667183 | 9/1990 | France | G06F 15/40 |
| 92/03804 | 3/1992 | WIPO | G07C 9/00 |

OTHER PUBLICATIONS

EPO Search Report, Nov. 11, 1994.

*Primary Examiner*—David C. Cain

*Attorney, Agent, or Firm*—Robert H. Whisker; Melvin J. Scolnick

[57] ABSTRACT

Method and apparatus for verification of documents belonging to selected groups of classes of such documents. The documents are verified to assure that information contained in the documents is authenticated and unchanged. In one embodiment of the subject invention the documents maybe identification cards including both text and an image of the bearer. Each document also includes encrypted information $E_i[M]$ derived from the document, and encrypted decryption key $CE_j[Di]$ for decrypting the encrypted information and information identifying the document as a member of the jth class $C_j$ of a group of classes of documents. Verifying apparatus validates the document by a scanning information from the document decrypting the encrypted decryption key an using the decryption key so obtained to decrypted the encrypted information and comparing the recovered encrypted information with information derived from the document directly. The verifying apparatus is responsive to enabling information from a data center to enable the verifying apparatus to decrypt the encrypted decryption key for any document in a selected group of classes.

27 Claims, 3 Drawing Sheets

METHOD AND APPARATUS FOR VERIFICATION OF CLASSES OF DOCUMENTS

BACKGROUND OF THE INVENTION

The present invention generally relates to a reliable document verification system and, in particular, relates to a reliable document verification system using a public key cryptosystem.

Throughout history one of the tasks undertaken by many people and organizations has been proving the authenticity of the information content of documents. The importance of actually proving the authenticity of a document can range from merely identifying a signature to verifying military and/or political intelligence. Further, as often as one tries to demonstrate the authenticity of a document, there is usually at least one party that attempts to forge a document. Hence, there has been, and probably will continue to be, an ongoing struggle to be able to reliably verify documents.

Over the years technological advances have brought new meaning to the word "document". Today, a document may be, for example, an electronically generated receipt from a banking machine or a digitized recording on an optical recording disk. For the purpose of this patent application, therefore, the word "document" should be interpreted to include any information placed on any medium including, but not limited to, magnetic disks, optical disks or paper.

Another, similar task that has just as colorful a history as document authentication is the secure communication of information commonly includes the use of encryption/decryption techniques. Similar to the forger referred to above, there is usually at least one party that is interested in either stealing the information being communicated that has been encrypted or supplying false information in an encrypted format so that the receiver thereof is disinformed, or both. Hence, throughout history various encryption/decryption schemes have been developed that, at least for a time, were thought to be secure only to discover that the security had been compromised. Again, technological advances have considerably changed the field of cryptography. For example, with modern computers many cryptographic techniques can be broken in a relatively short period of time due, primarily, to the speed that computers perform mathematical operations.

One presently secure cryptographic technique is generally known as the public key cryptographic system. One particular form of such a system is fully described and discussed in the basic article entitled "A Method For Obtaining Digital Signatures and Public Key Cryptosystems" by R. L. Rivest, A. Shamir and L. Adelmann, Volume 21 #2, February 1978, Communications of ACM pages 120–126. This particular system is frequently referred to as the RSA public key cryptosystem.

Public key techniques, as pointed out in the article entitled "Public Key Cryptography" by John Smith, in the January 1983 edition of Byte Magazine, pages 189–218, usually include two different kinds of keys: encryption keys and decryption keys. These keys includes the properties that: a) it is possible to compute a pair of keys including an encryption key and a decryption key; b) such that, for each pair, the decryption key that is not the same as the encryption key; and c) it is not feasible to compute the decryption key even from the knowledge of the encryption key. In addition, in such a cryptosystem, the encryption and decryption keys are functionally reversible, i.e. if one key is used to encrypt the other key can be used to decrypt whatever has been encrypted.

As known, the name "public key" is derived from the fact that each party's encryption key can be made available, i.e. public, to all parties subscribing to the particular public key network involved. Hence, as currently used, public key cryptographic systems are designed for the direct communication between any two subscribing parties, each party having an unpublished decryption key and a published encryption key.

The public key cryptographic system has also found use in providing accurate identification of the source of a document. As discussed on pages 217–218 of the Smith article, a sender can effectively sign a message by first encrypting the message, or an authenticating portion thereof, such as, for example, the name of the sender, using the private decryption key of the sender and then encrypt the message with the public encryption key of the receiving party. This results in a message portion that only the sender could have created and only the receiver can read. Hence, two party communication can, so long as public key cryptographic systems are secure, be implemented in such a fashion that the authenticity of a document can be ensured.

Nonetheless, there remain many instances where there is a need, or desire, for a third party to authenticate a document relevant to, or communicated between, two other parties. One example of such a situation would exist if a first party were required, or simply desired, to prove, or demonstrate, the authenticity of a particular document to a second party. In such a situation, it could be most beneficial if a third party could provide a means for authenticating that document. One particular situation that could exist would be where a dispute over the authenticity of a document arose between two parties and an impartial third party was selected to resolve the issue to the satisfaction of both parties. Such a situation might arise when, in accordance with an agreement between two parties, one of the parties was to maintain certain records such that the second party could review those records to ensure compliance with the agreement. In such a situation it would be most beneficial if a third party were available to demonstrate the accuracy/inaccuracy of the records to the auditing second party.

One solution to the problems described above is set forth in U.S. Pat. No. 4,853,961; to: Pastor; issued: Aug. 1, 1988; for: Reliable Document Authentication System. This patent discloses a system wherein information from a document, preferably postage information from a mailpiece is encrypted using an encryption key $E_i$ and incorporated with the document. The corresponding decryption key $D_i$ is encrypted with a second encryption key $E_1$ and also incorporated with the document. To verify the document as authenticate a party wishing to verify the document is provided with the decryption key $D_1$ corresponding to encryption key El, recovers key $D_i$ and decrypts the encrypted information, and compares it to the information originally in the document. The Pastor patent contemplates that all keys are provided by a trusted third party and thus the verifying party may be assured that the document has not been changed after the encrypted information was incorporated.

A particular application of this document verification technique is disclosed in commonly assigned, co-pending U.S. patent application Ser. No. 07/979,081; by; Marcus; filed: Nov. 20, 1992; for: Secure Identification Card and Method and Apparatus For Producing And Authenticating Same. Marcus discloses a system for producing and verifying identification cards; that is documents which serve to prove the identity and status of an associated person or other entity. In this application the encrypted information from the identification card would include information describing the person or other entity to be identified. Particularly, the encrypted information may include information representative of an image of a person to be identified. A typical example of such an identification card would be a driver's license which serves to identify the bearer and to confirm the bearer's status as a licensed driver.

As is well known, driver license's and similar identification cards are used not only for their intended purpose, but are also frequently used by third parties to verify the identity, age, etc. of the bearer. For example, retail establishments frequently wish to verify a driver's license before cashing a check or selling liquor. The system disclosed in the Marcus application is particularly adapted to this, since the keys provided to third parties will not allow the third party to forge false documents, as would be possible using single key systems.

While the system disclosed in the Marcus application is believed highly satisfactory for its intended purpose, it does not contemplate the problem of third party who wishes to verify documents from a number of sources. For example, a bar owner close to a state line may wish to have the capability to verify driver licenses from one or more neighboring states, while a similar bar owner in the middle of the state may have no need for such capability, while a retailer located near a popular tourist attraction may have a need to verify driver's licenses from all over the United States.

Consequently, it would be highly desirable to provide a method and apparatus for reliably validating documents in general and, in particular, to reliably validate documents belonging to a plurality of classes.

SUMMARY OF THE INVENTION

The above object is achieved and the disadvantages of the prior art are overcome in accordance with the subject invention by means of a method and apparatus for verifying a document belonging to a particular, jth class of documents, the jth class being one of a plurality of classes of documents, each corresponding to a particular encryption/decryption key pair CE,CD. The document incorporates encrypted information, $E_i[M]$ comprising information derived from the document and encrypted with an encryption key $E_i$ for an encryption/decryption key pair $E_i$, $D_i$, where the key pair $E_i$, $D_i$ can be varied from document to document and/or from class to class. The document further includes an encrypted decryption key $CE_j[D_i]$ formed by encrypting decryption key $D_i$ with encryption key $CE_j$. In accordance with the method and apparatus of the subject invention enabling information for enabling retrieval of a decryption key from any document in a selected group of classes is provided. It is then determined if the subject document is in the selected group, and if so the decryption key $D_i$ is retrieved from the document. Key $D_i$ is then used to decrypt the encrypted information $E_i[M]$ to obtain decrypted information $D_i[E_i[M]]$ and the information M is derived from the document. Decrypted information $D_i[E_i[M]]$ is then compared with information M to verify that the information contained in the subject document is authentic and unchanged.

In accordance with one aspect of the subject invention verifying apparatus for receiving the enabling information and for decrypting the encrypting information $E_i[M]$ includes a memory for storing preselected decryption keys CD, the keys CD being in one-to-one correspondence with the classes, and the verifying apparatus also includes an enabling apparatus responsive to the enabling information to enable the validating apparatus to access selected groups of the preselected keys. In accordance with this aspect of the subject invention the enabling information includes information defining a group of the preselected keys CD corresponding to the selected group of classes.

In accordance with another aspect of the subject invention the verifying apparatus comprises a memory for storing a plurality of decryption keys CD and the enabling information includes information defining a group of the decryption keys CD corresponding to the selected group of classes, and the verifying apparatus responses to the enabling information to store the group of keys CD in the memory. In accordance with another aspect of the subject invention the document incorporates a second encrypted decryption key $GE[D_i]$ encrypted with a group encryption key GE for an encryption/decryption key pair GE, GD. In accordance with this aspect of the subject invention documents in at least one other class of documents incorporate a third encryption decryption key encrypted with group encryption key GE. Still further in accordance with this aspect of the subject invention the verifying apparatus includes a memory for storing a decryption key and the enabling information includes information defining a corresponding group decryption key GD which enables decryption of encrypted decryption keys on all documents comprised in the selected group of classes, and the verifying apparatus responds to the enabling information to store decryption key GD in the memory.

In accordance with still another aspect of the subject invention, the enabling information is transmitted from a data center to the verifying apparatus in encrypted form.

In accordance with yet another aspect of the subject invention, request information is transmitted to the data center to request enabling information for a selected group of classes, the request information including encrypted information identifying the verifying apparatus, the data center decrypting the encrypted identifying information and responding to transmit the requested enabling information to the verifying apparatus.

Thus, it can been seen that the subject invention advantageously achieves the above object and overcomes the difficulties of the prior art by providing a method and apparatus for easily verifying groups of classes of documents. Other objects and advantages of the subject invention will be readily apparent to those skilled in the art from consideration of the attached drawings and the detailed descriptions set forth below.

DETAILED DESCRIPTION OF PREFERRED EMBODIMENTS OF THE SUBJECT INVENTION

Figure 1:
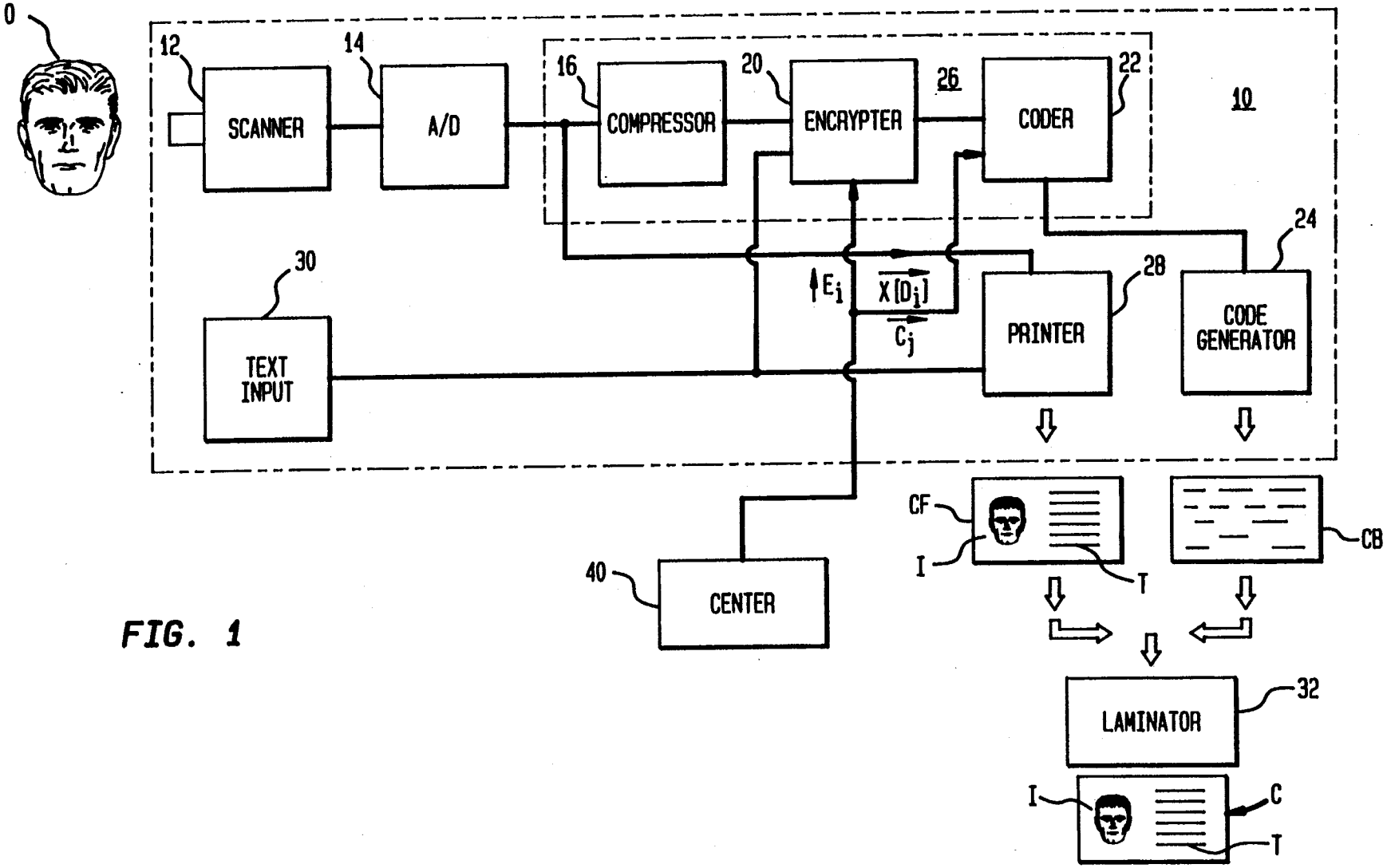
FIG. 1 is a schematic block diagram of an apparatus for producing a document to be verified in accordance with the subject invention.

FIG. 1 shows a schematic block diagram of apparatus 10 for producing a document, more particularly an identification card C. A person (or other object or entity) for whom the identification card is intended is scanned by a conventional video scanner 12 to produce a first signal representative of that person's image. Preferably, the first signal is then converted to a digital form by an analog-to-digital convertor 14 for processing in the digital domain.

The first signal is then input to a compression module 16 where it is compressed to reduce the amount of data which must be stored on identification card C.

Data compression algorithms, specifically adapted for compression of video image signals, are known to those skilled in the art. Preferably, an algorithm known as the JPEG algorithm, which is known and commercially available is used in compressor 16. Further description of the operation of compressor 16 is not believed necessary to an understanding of the subject invention.

The compressed first signal is then input to an encrypter 20 to be included in the encrypted second signal which will be incorporated into identification card C, as will be described further below. Encrypter 20 encrypts the second signal using an encryption key, $E_i$, for a public key encryption system such as the well known RSA system.

The encrypted second signal is then encoded in accordance with some predetermined format by coder module 22, which controls code generator 24 to incorporate the encoded encrypted second signal in a portion of identification card C.

In accordance with a preferred embodiment of the subject invention the coded signal is coded as a two dimensional barcode, such as the PDF-417 standard barcode, developed by the Symbol Technology Corporation of New York. However, the encrypted second signal may be coded into any suitable format. For example, for a smart card or a memory card coder 22 and code denerator 24 may store the coded second signal as an appropriately formatted binary data block.

Where the coded second signal is represented as a two dimensional barcode the barcode will preferably be printed on back CB of identification card C.

The digitized first signal is also input to printer 20 which may use any appropriate technology for the production of identification card C to print an image of the person O on from CF of identification card C. Front CF and back CB are then combined and laminated using well known technology by laminator 32 to product identification card C.

At least a portion of the text message is combined with the compressed from of the first signal to form the second signal which is encrypted by encrypter module 20 to provide encrypted information $E_i[M]$. Information M is also printed as plain text on the front CF of card C. Alternatively, text T may be compressed; as for example by deletion of control characters, which are restored in accordance with a predetermined format when text T is recovered, before text T is incorporated into the second signal. Thus, like image I text T is embodied in card C in both humanly recognizable form on the front CF and coded form on the back CB of card C.

In a preferred embodiment of the subject invention a data center 40 transmits encryption code $E_i$ to encrypter module 20. In order to increase the security of identification card C key $E_i$ maybe changed from time to time. For the highest level of security key $E_i$ maybe changed for each card C produced.

To facilitate decryption of encrypted information $E_i[M]$ data center 40 also transmits an encrypted decryption key $X[D_i]$ to be appended to the encrypted information $E_i[M]$ by coder module 22. Encryption key X can be either a class encryption key CE for a particular class of documents produced by apparatus 10, or, in other embodiments of the subject invention may be a group encryption key GE for a group of classes of documents, or in still other embodiments of the subject invention decryption key $D_i$ can be encrypted with both a class encryption key CE and one or more group encryption keys GE. Additionally, an unencrypted representation of the particular class $C_j$ is also appended to the encrypted information $E_i[M]$ by coder module 22. Thus, as will be seen below, when card C is to be verified the necessary decryption key $D_i$ can be obtained by decrypting encrypted decryption key $X[D_i]$.

Figure 2:
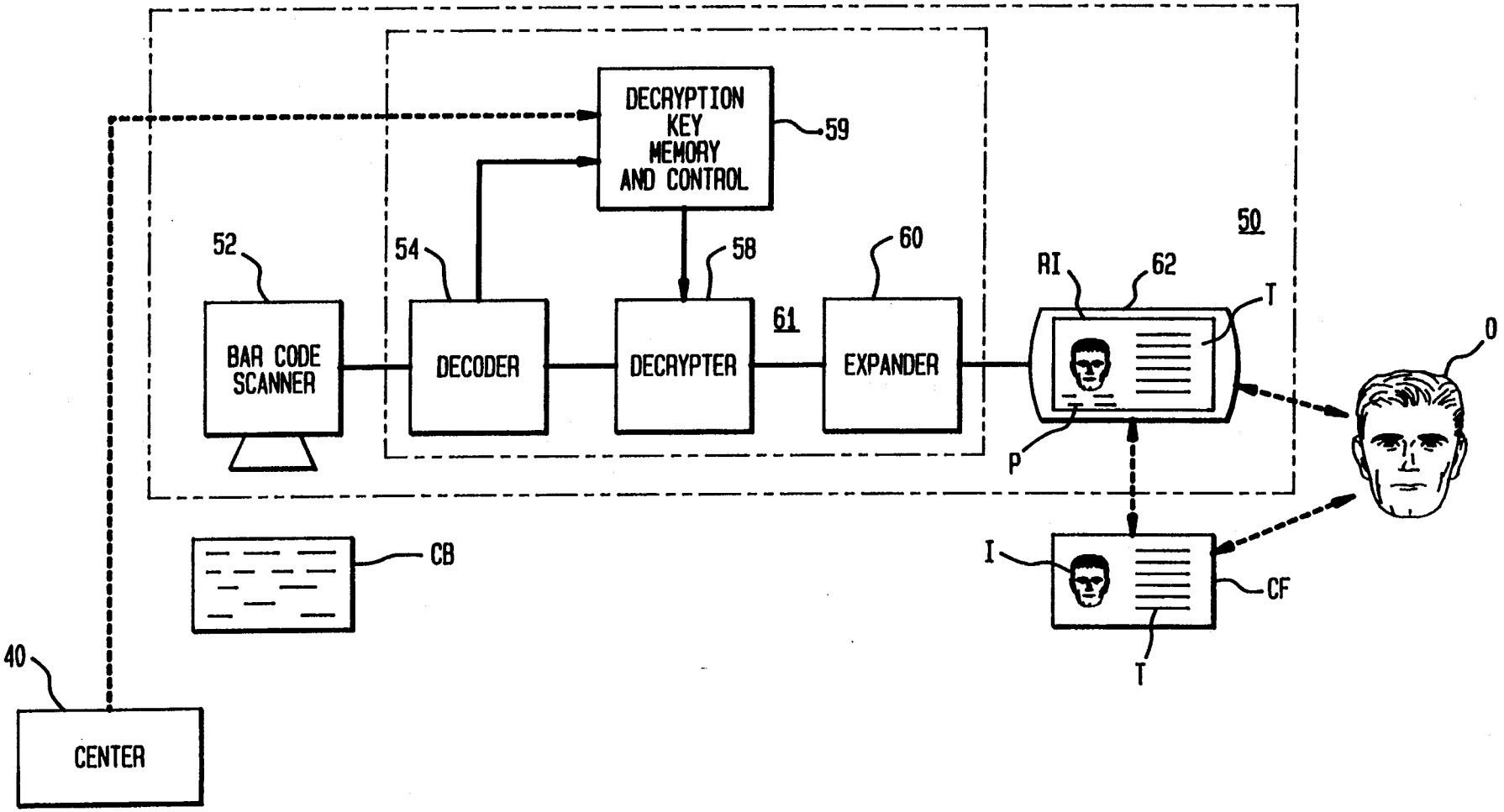
FIG. 2 is a schematic block diagram of an apparatus for verifying an identification card produced in accordance with the subject invention.

Turning now to FIG. 2 apparatus 50 for validating an identification card C is shown. The back CB of card C is scanned by a barcode scanner 52 having the capability to scan an appropriate two dimensional barcode. The scanned signal is then decoded by decoder module 54 and decrypted by decrypter module 58. In a preferred embodiment of the subject invention decrypter 58 stores decryption key X, which is used to decrypt encrypted key $X[D_i]$to obtain decryption key $D_i$; as will be further described below, in key memory 59. Key $D_i$ is then used to decrypt the decoded signal scan from card back CB.

Key X (or keys) is obtained by decrypter 58 form center 40. Typically, key X will remain constant during operation of system 50, as described above, and a direct communication link between system 50 and center 40 is not necessary and key X maybe transmitted in any convenient manner.

The decrypted scan signal is then expanded in by an algorithm complimentary to the compression algorithm used in system 10, in a conventional manner which need not be described further for an understanding of the subject invention.

The decrypted, expanded signal is then displayed by a conventional display 62. The display includes a representation RI of image I and the text message T which was included in the encrypted second signal scanned from card back CB. To verify the card image I is compared with its representation RI and the text message T as printed on card C and as shown on display 62 are compared. It should be noted that with compression representation RI will be somewhat degraded with respect to image I. It has been found however that using the above described JPEG algorithm a sufficiently accurate representation of an image of a person's face maybe coded as approximately 1,000 bytes of data and printed suing the above described PDF-417 two dimensional barcode in an area of approximately 2.50 by 1.75 inches on the back of a substantially conventional wallet sized card. Of course, as described above, with improvements in storage technology and/or the use of media having a high data storage capacity as embodiments of identification cards C representation RI can be arbitrarily close to image I.

Once card C is validated by comparison of image I and text message T printed on card from CF with representation RI and the text message T as shown on display 62 then the identify of the person O carrying card C maybe confirmed by comparison of person O with image I. Text message T will then confirm the identity of person O and may also confirm the status or characteristics of person O.

Figure 3:
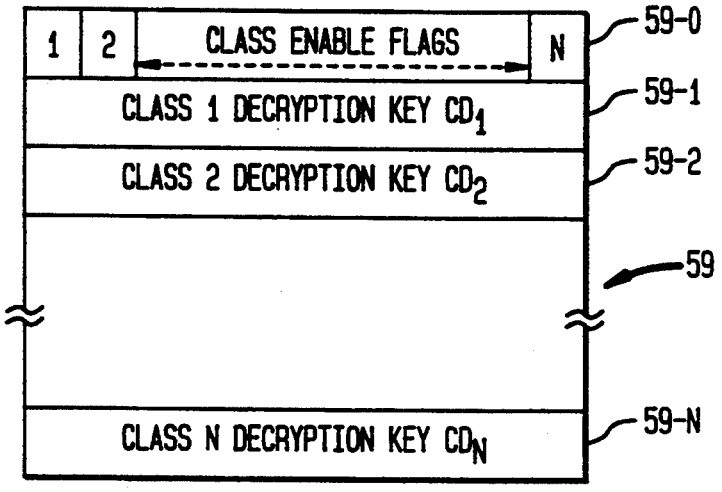
FIGS. 3 and 4 are a schematic representations showing the data relationships between a document and the validating apparatus for various embodiments of the subject invention.

Turning to FIG. 3, the data relationships between keys stored in key memory 59 and the coded information on card back CB for a preferred embodiment of the subject invention is shown. Memory 59 includes storage location 59-0 which comprises class enable flags 1-N. Additionally, memory 59 includes storage locations 59-1 through 59-N which initially store predetermined class decryption keys $CD_1$ through $CD_N$. To enable a selected group of classes apparatus 50 receives enabling information from data center 40. In accordance with this embodiment of the subject invention the enabling information comprises a code word which is written into location 59-0. Asserted bits of the code word enable the corresponding class decryption keys. That is, if the jth bit of the code word is asserted class decryption key $CD_j$ is enabled.

To validate a document apparatus 50 scans the information from card back CD as described above. From the unencrypted class identification $C_j$ apparatus 50 determines that card C is in the particular class $C_j$, apparatus 50 then tests the jth bit of storage location 59-0 and if the bit is asserted decrypts the encrypted decryption key $CE_j[D_i]$ with the corresponding, enabled class decryption key $CD_j$, decrypts the encrypted information $E_i[M]$ and validates the card as described above.

Typically, apparatus 50 will be primarily intended to validate particular class Cj and the jth bit of location 59-0 will initially be asserted. For example, if apparatus 50 is located in a particular state and card C is a driver's license then class $C_j$ will be driver's licenses issued by that state and the jth bit will be initially asserted in location 59-0.

At a later time the user of apparatus 50 may wish to add additional classes of documents which can be verified. For example, the user may wish to verify driver's licenses from neighboring states. To do this the user requests enabling information from data center 40. In response to this request data center 40 transmits a new code word wherein bits corresponding to the class decryption keys for the neighboring states are asserted.

In accordance with a preferred embodiment of the subject invention this enabling information maybe encrypted, either with class encryption key $CE_j$ or with any other convenient key, and decrypted by apparatus 50 prior to storing the code word in location 59-0.

More particularly, enabling information may be transmitted to apparatus 50 in substantially the same manner as information for recharging of postage meter is transmitted, as is described in U.S. Pat. No. 4,097,923 to: Eckert, Jr. et al.; issued: Jun. 27, 1978, which is hereby incorporated by reference. In this embodiment of the subject invention apparatus 50 would transmit an identification code as well as encrypted information which would include a request for enabling information to enable a selected group and a secure serial number not accessible to users of apparatus 50. The encrypted information can be encrypted with class decryption key $CD_j$ or any other convenient key. Upon receipt of this request data center 50 identifies the appropriate key to decrypt the encrypted information with encryption key $CE_j$ or other appropriate corresponding key.

Data center 40 then generates appropriate enabling information, i.e. a code word having the bits corresponding to the requested classes asserted, and encrypts it with class encryption key $CE_j$ or other convenient key and transmits the encrypted enabling information to apparatus 50 for decryption and storage in location 59-0.

As noted above decryption keys used by apparatus 50 will not normally be changed during normal operations and accordingly data maybe transmitted between apparatus 50 and data center may take place in any convenient manner including, but not limited to: communications over a data communications link, physical transmission of installable data storage devices such as floppy disks or programmable read only memory chips, or transmission between human operators for manual data input.

In alternative embodiment, similar to that discussed above, the enabling information may comprise class decryption keys comprised in a selected group and the remaining locations in memory 59 will contain null information. In this embodiment class enabling flags 59-0 are unnecessary since attempted decryption with null information will produce meaningless results.

In still another alternative embodiment where it is desired to allow verifying apparatus to verify later added classes without communicating with a data center, memory 59 stores all present and possible future class decryption keys CD which are all permanently enabled.

Figure 4:
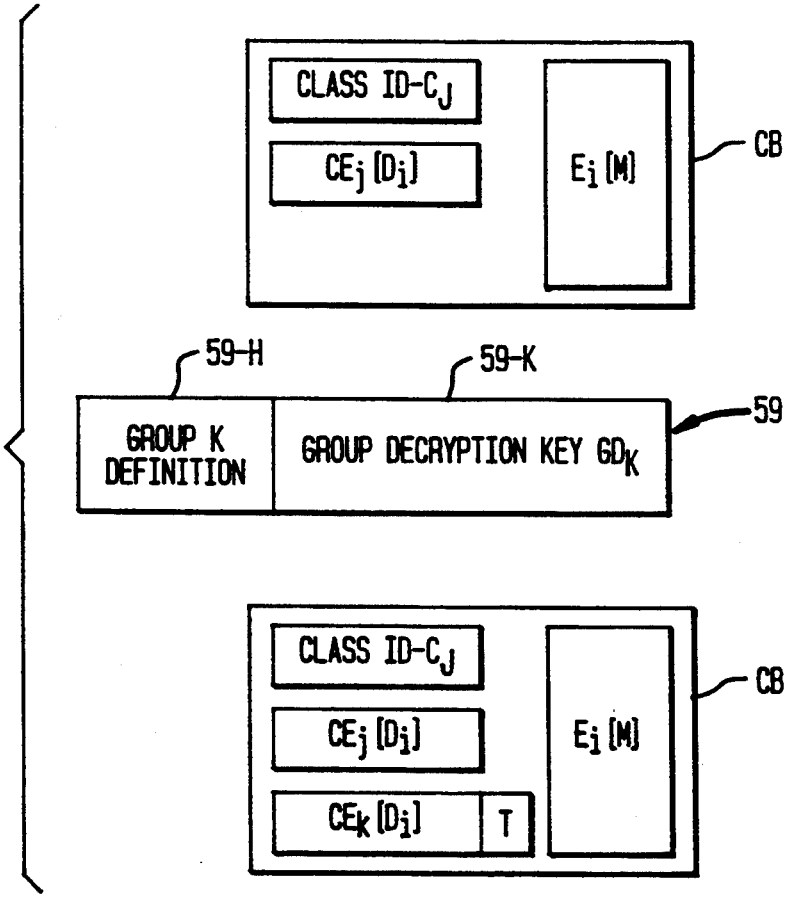

FIG. 4 shows the data relationship for another embodiment of the subject invention wherein memory 59 includes only a single storage location having two portions, a group decryption key $GD_k$ portion 59K and a group definition portion 59-h. Card back CB includes a class identification $C_j$, and encrypted decryption key $CE_j[Di]$, and encrypted information $E_i[M]$, all as described above. Additionally, card back CB includes an encrypted decryption key $GE_k[Di]$ encrypted with a group encryption key $GE_k$ which is used for at least one other class of documents. That is, there is at least 1 class $C_k$ of documents wherein a decryption key $D'_i$ is encrypted with group encryption key $GE_k$. To validate the information apparatus 50 reads the class identification $C_j$ and tests it against the group K definition 59-h to determine if the group decryption key $GD_k$ can be used to decrypt decryption key $D_i$ for documents in class $C_j$ apparatus 50 then decrypts encrypted decryption key $GE_k[Di]$ to recover decryption key $D_i$ and validates card C as described above.

It will be apparent that cards in class $C_j$ may belong to more then one group of classes, in which case card back CB will include appropriate corresponding encrypted decryption keys encrypted with appropriate group encryption keys. In this case the encrypted decryption keys $GE[D_i]$ will include a tag T so that the appropriate encrypted decryption key can be quickly identified without the need for trial and error decryption of all keys.

In this embodiment of the subject invention enabling information to change the group of classes which apparatus 50 can validate would include the appropriate group decryption key and the appropriate header identifying the classes which can be validated.

The preferred embodiments described above have been given by way of example only, and other embodiments of the subject invention will be apparent to those skilled in the art from consideration of the detailed descriptions set forth above and the attached drawings. Accordingly, limitations in the subject invention are to be found only in the claims set forth below.

Particularly, the subject invention is not limited to identification cards but is applicable to any document including image data, text, or combinations thereof or any other convenient form of information for which the need exists for validation that the information is authentic and unchanged.

While the preferred embodiment identifies the class of a document by identification information $C_j$ it is also within the contemplation that the class may be determined by attempting to decrypt the document with all available decryption keys and testing the results for a meaningful message.

What is claimed is

1. A method for verifying a document belonging to a particular class of documents, said particular class being one of a plurality of classes of documents, each of said classes corresponding to a class encryption/decryption key pair CE,CD, said document incorporating encrypted information E comprising information M derived from said document and encrypted with an encryption E selected from an encryption/decryption key pair E, D and said document further incorporating an encrypted decryption key DE comprising decryption key D selected from said key pair E, D encrypted with encryption key CE; selected from encryption decryption key pair CE,CD associated with said particular class, said method comprising the steps of:

a) providing enabling information for enabling retrieval of a decryption key from any document in a selected group of said classes;

b) determining if said document is in said selected group, and if so retrieving said decryption key D from said document;

c) decrypting said encrypted information E to obtain decrypted information D and deriving said information M from said document; and d) comparing said decrypted encrypted information $D_i$ D with said information M to verify the information contained in said document as authentic and unchanged.

2. A method as described in claim 1 further comprising the step of:

a) providing verifying means for receiving said enabling information and for decrypting said encrypted information E, said verifying means further comprising memory means for storing preselected decryption keys CD, said preselected keys CD being in one-to-one correspondence with said classes, and still further comprising means responsive to said enabling information for enabling said verifying means to access selected groups of said preselected keys; and wherein, b) said enabling information comprises information defining a group of said preselected keys CD corresponding to said selected groups of classes.

3. A method as described in claim 2 wherein said enabling information comprises a code word, the bits being in one-to-one correspondence with said preselected keys CD, said verifying means storing said code word and said enabling means responding to said code word to enable access to one of said preselected keys if and only if a corresponding bit of said code word is asserted.

4. A method as described in claim 3 wherein said code word is encrypted, said verifying means decrypting said code word prior to storing said code word.

5. A method as described in claim 4 wherein said verifying means initially stores a first code word code having an asserted bit corresponding to a particular one of said preselected keys CD said particular one of said preselected keys CD corresponding to said particular class; and wherein subsequent values for said code word are encrypted with a corresponding key CE.

6. A method as described in claim 2 comprising the further step of:

a) transmitting request information to a data center, said request information including encrypted information identifying said verifying means and a request for enabling information defining said group of said preselected keys CD corresponding to said selected group of classes: wherein said data center decrypts said encrypted identifying information and responds to send said requested enabling information to said verifying means.

7. A method as described in claim 1 further comprising the steps of:

a) providing verifying means for receiving said enabling information and for decrypting said encrypted information E, said verifying means further comprising memory means for storing a plurality of decryption keys CD; and wherein, b) said enabling information comprises information defining a group of said decryption keys CD corresponding to said selected group of classes; and c) said verifying means further comprises means responsive to said enabling information for storing said group of decryption keys in said memory means.

8. A method as described in claim 7 wherein said verifying means initially stores at least a particular one of said decryption keys CD for said particular class and subsequent values for said enabling information are encrypted with a corresponding key CE.

9. A method as described in claim 7 comprising the further step of:

a) transmitting request information to a data center, said request information including encrypted information identifying said verifying means and a request for enabling information defining said group of said decryption keys corresponding to said selected group of classes; wherein said data center decrypts said encrypted identifying information and responds to send said requested enabling information to said verifying means.

10. A method as described as claim 1 wherein said document further incorporates a second encrypted decryption key GE encrypted with a group encryption key GE for an encryption/decryption key pair GE,GD, and wherein documents in at least a a second particular class incorporate a third encrypted decryption key GE, and further comprising the step of:

a) providing verifying means for receiving said enabling information and for decrypting said encrypted information E, said verifying means further comprising memory means for storing a decryption key; and wherein, b) said enabling information comprises information defining a group decryption key GD for said key pair GE, GD, said decryption key GD enabling decryption of encrypted decryption keys on all documents comprised in said selected group; and c) said verifying means further comprises means responsive to said enabling information for storing said decryption key GD in said memory means.

11. A method as described in claim 10 wherein said enabling information comprises said group decryption key GD in encrypted form.

12. A method as described in claim 11 wherein said verifying means initially stores said class decryption key CD; and said enabling information further comprises an encrypted group decryption key CE encrypted with said corresponding encryption key CE.

13. A method as described in claim 10 comprising the further step of:

a) transmitting request information to a data center, said request information including encrypted information identifying said verifying means and a request for enabling information defining said group decryption key GD, wherein said data center decrypts said encrypted identifying information and responds to transmit said requested enabling information to said verifying means.

14. A method for verifying a document belonging to a particular class of documents, said particular class of documents corresponding to an encryption decryption key pair CE,CD, said document incorporating encrypted information E comprising information M derived from said document and encrypted with an encryption key selected from an encryption/decryption key pair E,D an encrypted decryption key CE comprising decryption key D encrypted with encryption key selected from key pair CE,CD and class formation identifying said document as belonging to said particular class, said method comprising the steps of:

a) providing validating means for decrypting said encrypted information E, said validating means comprising memory means for storing a sequence of preselected decryption keys wherein one key CD in said sequence is the decryption key for said key pair CE,CD, and means responsive to said class information for retrieving keys from said memory means;

b) inputting said class information from said document to said validating means;

c) said validating means retrieving said one key CD in said sequence from said memory means;

d) said validating means then decrypting said encrypted decryption key CE to obtain said decryption key, D and then decrypting said encrypted information E to obtain decrypted information D;

e) deriving said information M from said document; and, f) comparing said decrypted information D from said verifying means with said information M to verify the information contained in said document as authentic and unchanged.

15. An apparatus for verifying a document belonging to a particular class of documents, said particular class being one of a plurality of classes of document, each of said classes corresponding to a class encryption/decryption key pair CE,CD, said document incorporating encrypted information E comprising information M derived from said document and encrypted with an encryption key E selected from an encryption/decryption key pair E, D and said document further incorporating encrypted decryption, key CE comprising decryption key D for said key pair E, D encrypted with encryption key CE selected from class encryption/decryption key pair CE, CD associated with said particular class, comprising:

a) means for scanning said document to input scanned information, said scanned information including said encrypted information E, said encrypted decryption key CE, and information identifying said particular class;

b) means responsive to enabling information for enabling retrieval of a decryption key from any document in a selected group of said classes of documents and responsive said identifying information to determine if said document is in said selected group, and if so retrieving said decryption key D from said scanned information;

c) means for decrypting said encrypted information E from said scanned information to obtain decrypted encrypted information D; and d) means for comparing said decrypted encrypted information D with said information M to verifying the information contained in said document as authentic and unchanged.

16. An apparatus as described in claim 15 wherein said enabling means further comprises memory means for storing preselected keys CD, said preselected keys CD having a one-to-one correspondence with said classes, and wherein said enabling means responds to said enabling information to enable access to a group of said preselected keys CD, said group of keys corresponding to said group of classes.

17. An apparatus as described in claim 16, wherein said enabling information comprises a code word, and said enabling means further comprises a storage location for storing said code word, bits of said code word being in one-to-one correspondence with said preselected keys, said apparatus further comprising means for storing said code word in said storage location upon receipt of said enabling information and said enabling means responding to asserted bits of said stored code word to enable access to corresponding ones of said keys CD.

18. An apparatus as described in claim 17 wherein said code word is encrypted, said decrypting means being further for decrypting said code word prior to storing said code word.

19. An apparatus as described in claim 16 further comprising:

a) means for transmitting request information to a data center, said request information including encrypted information identifying said apparatus and a request for enabling information defining said group of said preselected keys CD corresponding to said group of classes, wherein said data center decrypts said encrypted identifying information and responds to send said requested enabling information to said apparatus.

20. An apparatus as described in claim 15 wherein said enabling means further comprises a memory means for storing a plurality of said preselected keys CD, and wherein said enabling information comprises information defining a group of said decryption keys CD corresponding to said selected group of classes; said apparatus further comprising means responsive to said enabling information for storing said group of decrypting keys in said memory means.

21. An apparatus as described in claim 20 wherein said apparatus initially stores at least a particular one of said decryption keys CD for said particular class and subsequent values for said enabling information are encrypted with said particular one of said keys CD.

22. An apparatus as described in claim 20 further comprising:

a) means for transmitting request information to a data center, said request information including encrypted information identifying said apparatus and a request for enabling information defining said group of said preselected keys CD corresponding to said group of classes, wherein said data center decrypts said encrypted identifying information and responds to send said requested enabling information to said apparatus.

23. Am apparatus as described in claim 15 wherein said document further incorporates a second encrypted decryption key GE encrypted with a group encryption key GE selected from an encryption/decryption key pair GE,GD, and wherein documents in at least a kth class incorporate a third encrypted decryption key GE; and said enabling means further comprises memory means for storing a decryption key GD selected from said encryption/decryption key pair GE,GD, said decryption key GD enabling decryption of encrypted decryption keys on all documents comprised in said selected group; said apparatus further comprising means, responsive to said enabling information for storing said decryption key GD in said memory means.

24. An apparatus as described in claim 23 wherein said enabling information comprises said group decryption key GD in encrypted form and said decrypting means is further for decrypting said encryption of decryption key GD prior to storing said decryption key GD in said memory means.

25. An apparatus as described in claim 24 wherein said apparatus initially stores one of said decryption keys CD associated with said particular class and said enabling information comprises encrypted decryption key CE encrypted with said corresponding encryption key CE.

26. An apparatus as described in claim 23 further comprising:

a) means for transmitting request information to a data center, said request information including encrypted information identifying said apparatus and a request for enabling information defining said group decryption key GD; wherein said data center decrypts said encrypted identifying information and responds to transmit said request enabling information to said apparatus.

27. An apparatus for validating a document belonging to a particular class of documents, said particular class of documents corresponding to an encryption/decryption key pair CE,CD, said document incorporating encrypted information E comprising information M derived from said document and encrypted with an encryption key E selected from an encryption/decryption key pair E,D and encrypted decryption key CE comprising decryption key encrypted with encryption key CE selected from key pair CE,CD, and class information identifying said document as belonging to said particular class, said apparatus comprising:

a) means for scanning said document to input scanned information, said scanned information including said encrypted information E said encrypted decryption key CE, and information identifying said particular class;

b) memory means for storing a sequence of preselected decryption keys $CD_1$, $CD_2$, . . . $C_n$, wherein one key CD in said sequence is the decryption key for said key pair c) means responsive to said class identifying information for retrieving said one key CD from said memory means, d) means responsive to said one key CD for decrypting said encrypted decryption key CE and then decrypting said encrypted information E to obtain decrypted information D; and e) means for comparing said decrypted encrypted information D with said information M to validate said document as authentic and unchanged.

* * * * *